United States Patent [19]

Bisson et al.

[11] Patent Number: 4,903,620

[45] Date of Patent: Feb. 27, 1990

[54] AUTOMATIC EXCHANGE OF THE SIZE IN AN AUTOMATIC SEWING UNIT

[75] Inventors: Flavio Bisson, Cava Manara; Piero Negri, Pavia, both of Italy

[73] Assignee: Necchi Societa per Azioni, Pavia, Italy

[21] Appl. No.: 331,601

[22] Filed: Mar. 31, 1989

[30] Foreign Application Priority Data

Jun. 7, 1988 [IT] Italy ..... 32306/88[U]

[51] Int. Cl.[4] ..... D05B 21/00; D05B 3/00

[52] U.S. Cl. ..... 112/121.12; 112/121.14; 112/121.15; 112/104

[58] Field of Search ..... 112/121.15, 121.12, 112/121.14, 121.11, 153, 308, 309, 104

[56] References Cited

U.S. PATENT DOCUMENTS

| | | | |
|---|---|---|---|
| 3,080,836 | 3/1963 | Clemens et al. | 112/308 X |
| 3,722,441 | 3/1973 | Kitchener et al. | 112/309 |
| 4,006,698 | 2/1977 | Scholl et al. | 112/121.14 X |
| 4,307,675 | 12/1981 | Off et al. | 112/153 X |
| 4,312,283 | 1/1982 | Fischer et al. | 112/121.12 |
| 4,455,952 | 1/1984 | Morin et al. | 112/121.15 X |
| 4,494,470 | 1/1985 | Fischer et al. | 112/121.14 X |
| 4,512,271 | 4/1985 | Hendey et al. | 112/121.12 X |
| 4,632,046 | 12/1986 | Barrett et al. | 112/121.14 |
| 4,712,494 | 12/1987 | Bisson | 112/121.12 |
| 4,722,290 | 2/1988 | Manuel et al. | 112/309 X |

*Primary Examiner*—H. Hampton Hunter

*Attorney, Agent, or Firm*—Stevens, Davis, Miller & Mosher

[57] ABSTRACT

Automatic size changer on an automatic sewing unit comprising a sewing machine, a clamp set formed at least by two half-clamps, a loader set formed at least by two half-plates for loading the pieces to be sewn in the clamp set, one of the half-clamps and one of the half-plates being mobile for handling various sizes, a motor for moving the mobile clamp and plate and sensor means cooperatable with the mobile half-plate for determining the size of the pieces to be sewn, the sensor means comprising a first pair for determining the tolerance field of the selected size.

4 Claims, 1 Drawing Sheet

AUTOMATIC EXCHANGE OF THE SIZE IN AN AUTOMATIC SEWING UNIT

Figure 1:
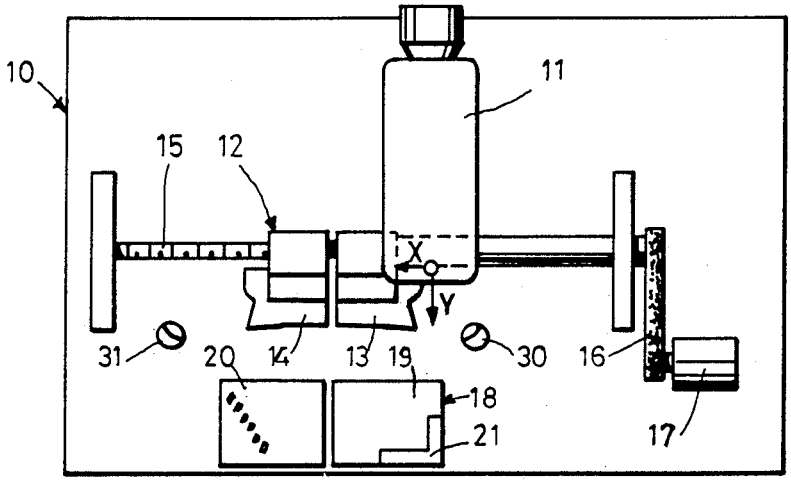

The present invention relates to an automatic exchange of the size in an automatic sewing unit for sewing, for example, collars or cuffs.

In the sewing units of the numeric control type, the fabric supporting frame is divided in two half-clamps and the sewing machine moves along a predetermined contour where the values of the coordinates of said contour are stored in an E P R O M. When the size is changed, the operator handles a hand-wheel which displaces a half-clamp with respect to the other one until the desired size is obtained, then reads on a scale the displacement effected with reference to the basic size and inserts the value of this displacement into the numeric control of the sewing machine.

This last insertion will execute a path according to the new values. If the reading of the operator has not been executed with precision, or if the data fed into the numeric control are not correct, during the sewing cycle the machine executes a size profile different from the one predetermined on the half- champs and, as a consequence at least an imperfect sewing of the fabric piece occurs, In the worst case, there is a breakage of the sewing means (needle) which strike a half-clamp and causes, a plate-displacement of the machine.

In the more advanced automatic units a fabric loader is formed by two half-plates, one fixed, on the other mobile.

On each half-plate a reference block is provided against which the fabric is placed. The operator places the work against the block, placed on the fixed half-plate and inspects it to determine if the other end of the work is in contact with the other block of the mobile half- plate.

If the condition is not verified, the operator, by means of a switch, operates a motor which controls the displacement of the mobile half-plate and of the half-clamp which clamps the fabric to be sewn. The operator operates said motor until the fabric comes into contact with the reference block of the mobile half-plate, then a signal is sent to the numeric control which controls the displacement of the sewing machine along a predetermined axis until a proximity placed on the machine is commutated by a metallic block fixed to the mobile half-clamp. In this position the numeric control memorizes the absolute value of the axis. The size is obtained in the numeric control as the difference between the trigger coordinate of the proximity and a fixed coordinate memorized in the E P R O M. Many times in a working day, the operator must provide the change of the size and since the characteristic value of each size has a definite tolerance, it is a job the operator, in placing the work on the loading plate, to judge if the piece to be sewn is included in the size of the previous on or it is necessary to change the size.

The operation of the exchange of the size requires the attention of the operator and thus a certain time which weighs on the daily production and thus on the costs.

To judge if a piece is included into the tolerance field of the size of the previous one involves the subjective intervention of the operator and thus the possibility of valuation mistakes which may cause an imperfect sewing of the pieces and a consequent increase of the discarding in the production. It is the purpose of the present invention to provide a means to overcome the above described drawbacks.

The technical problem to be solved was to realize an automatic exchange of the size which does not trace the subjective judging of the operator.

The solution of the technical problem is characterized by the fact that sensor means cooperate by couples with the mobile half-plate for determining the size of the pieces to be sewn, a first couple of said sensor means being provided for determining the tolerance field of the selected size.

Figure 2:
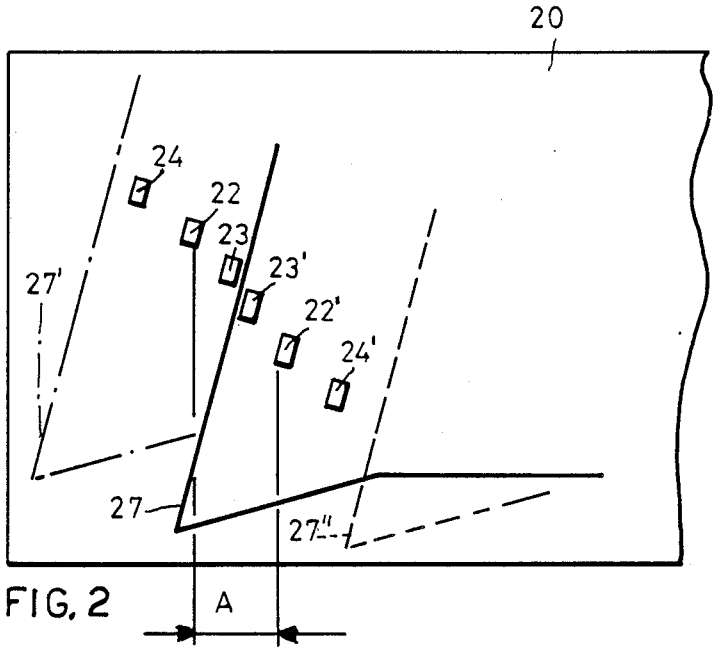

Other details and features of the invention will stand out from the description given below by way of non-limitative example and with reference to the accompanying drawings, in which:

FIG. I is a top plan view of the automatic unit to which the automatic exchange of the size, object of the present invention, is applied and FIG. 2 shows in detail a particular of the automatic exchange of the size of FIG. I.

With reference to FIG. I it is indicated in a generic way with 10 an automatic sewing unit, for sewing collars, comprising a sewing machine 11 which automatically moves in a known way along the X,Y axis in order to follow the contour of a clamp set I2 formed by a fixed half-clamp I3 and by a half-clamp I4 displaceable along the X axis by means of the worm- screw I5 driven, via a belt I6, by a motor I7 in order to obtain the size exchange as will be hereafter explained.

The automatic unit I0 comprises also a fabric loader I8 formed by two half-plates I9 and 20, fixed and mobile respectively. A point cuttler 30 is connected to the fixed half-plate I9 and a mobile point-cutter 3I to the mobile half-plate 20. The half-plate 20 and the point-cutter 3I are displaceded along the X axis when the size is changed and the half-clamp I4 is displaced. The displacement of the half-clamp 20 and of the the point-cutter 3I is operated by the motor I7 via a worm- screw, not shown in the drawing, which acts on the support of the point-cutter 3I to which the half-plate 20 is also fixed. A block 2I is placed on the half-plate I9 as a reference for the operator which, in the loading of the collar to be sewn on the loader I8, must set an end of the collar against the reference block 21.

The half-plate 20 cooperates with sensor means which in the described example are couples of photocells, the function of which will be hereafter described.

The pair of photocells 22 and 22' are placed at a predetermined distance, corresponding to the tolerance field A of the selected size. The pair of photocells 23 and 23' determines the setting of the size with a very restricted tolerance near zero. The pair of photocells 24 and 24' commands a quick displacement of the mobile half-plate 20 and consequently of the point cutter 3I and of the mobile half-clamp I4 for the exchange of the size. When the operator places the collar to be sewn on the loader I8 in such a way that an end of said collar is in contact with the reference block 2I of the half-plate I9, if the opposite end of the collar obscures the photocell 22 and does not obscure the photocell 22', it means that the collar is included into the tolerance field of the selected size; the loading of the clamp I2 and the sewing of the collar thus occurs.

When the end of the collar 27' (indicated in FIG. 2 with a dotted line) is placed on the mobile half-plate 20 and obscures the photocell 22, it means that the size of the collar to be sewn is greater than the previous one, thus a displacement of the half-plate 20, by means of the motor I7, occurs, until the photocell 23 is no more obscured. In this way there is the setting of the size near to zero.

If the photocell 24 is obscured, it means the size of the collar to be sewn is greater than the previous one. A quick displacement of the half-plate 20 thus occurs until the photocell 24 is no more obscured.

A slower displacement of the half-plate 20 is thus obtained until the the photocells 22 and 23 are no longer obscured.

When the end of the collar 27 is placed as it is indicated with continuous line in FIG. 2, the motor I7 stops and the new size is selected either on the plate I8 or on the clamp I2. When the end of the collar 27'' is placed, as illustrated in dotted line in FIG. 2, on the half-plate 20 without obscuring the photocell 24; it means that the size of the collar to be sewn is smaller than the selected one. There is therefore a quick displacement of the half-plate 20 until the photocell 24' is obscured, and then a slower progress until the end of the collar 27 is placed between the couple of photocells 23 and 23'. Each time the motor is driven for exchanging the size, the end of the collar 27 of the new selected size is always placed between the couple of photocells 23 and 23' so to have always at disposition, for each exchange of the size, the field of tolerance A for the following collars which must be loaded on the loader I8.

When both of the photocells 22 and 22' are or are not obscured, it means that the size of the collar placed on the loader I8 is not of the same size of the previous one, a signal is therefore sent to the motor I7 for the exchange of the size, as it has been previously explained.

The pair of photocells 24' is not indispensable as regards the automatic exchange of the size, but its function, is to produce, when both of the photocells are or are not obscured, a quick displacement of the half-plate 20 until it arrives at one of the photocells 22 and 22' so as to reduce the time for the size exchange operation and thus obtain an inerease in production.

We claim:

1. Automatic size changer on an automatic sewing unit comprising a sewing machine, a clamp set formed at least by two half-clamps, a loader set formed at least by two halfplates for loading the pieces to be sewn in said clamp set, one of said half-clamps and one of said half-plates being mobile for handling various sizes, a motor for moving said mobile clamp and plate and sensor means cooperatable with the mobile half-plate for determining the size of the pieces to be sewn, said sensor means comprising a first pair for determining the tolerance field of the selected size.

2. Automatic size charger according to claim 1 including a second pair of sensors for determining the setting of the size with tolerance near to zero, said second pair of sensors acting when said piece to be sewn is not included in the tolerance field of said first pair of sensors.

3. Automatic size exchanger according to claim 1 including a third pair of sensors, said third pair of sensors intervening when said piece to be sewn is not included into the tolerance field of said first pair of sensors for quickly displacing said mobile half-clamp.

4. Automatic size exchanger according to claim 1 wherein said pairs of sensors are photocells.

* * * * *